US005540436A

United States Patent [19]

Boone

[11] Patent Number: 5,540,436

[45] Date of Patent: Jul. 30, 1996

[54] SET OF GOLF CLUB IRONS HAVING A LOW DENSITY REAR CAVITY PERIMETER INSERT FOR SELECTED WEIGHT DISTRIBUTION OF EACH IRON

[75] Inventor: David D. Boone, El Toro, Calif.

[73] Assignee: Lynx Golf, Inc., City of Industry, Calif.

[21] Appl. No.: 329,087

[22] Filed: Oct. 25, 1994

[51] Int. Cl.[6] ..... A63B 53/04

[52] U.S. Cl. ..... 473/350; 473/405

[58] Field of Search ..... 273/167 R, 167 H, 273/167 F, 169, 170, 171, 172, 173, 77 A; D21/220

[56] References Cited

U.S. PATENT DOCUMENTS

| | | | |
|---|---|---|---|
| 4,715,601 | 12/1987 | Lamanna | 273/169 |
| 4,883,274 | 11/1989 | Hsien | 273/171 |
| 5,016,882 | 5/1991 | Fujimura | 273/167 H |
| 5,184,823 | 2/1993 | Desbiolles | 273/167 H |
| 5,193,805 | 3/1993 | Solheim | 273/77 A |
| 5,297,794 | 3/1994 | Lu | 273/167 F |
| 5,330,187 | 7/1994 | Schmidt | 273/167 H |
| 5,356,138 | 10/1994 | Chen | 273/167 F |

FOREIGN PATENT DOCUMENTS

| | | | |
|---|---|---|---|
| 2251556 | 7/1992 | United Kingdom | 273/167 R |

*Primary Examiner*—Sebastiano Passaniti
*Attorney, Agent, or Firm*—Leonard Tachner; Flam & Flam

[57] ABSTRACT

An improved set of golf club irons, wherein each golf club iron head has a structure for redistributing weight of the club towards the perimeter thereof, particularly in the rear cavity region. This is accomplished by increasing the volume of the cavity by using an undercut perimeter which permits weight redistribution for example to increase the thickness of the top line, the toe and the sole of the club head. However, the undercut portion of the invention is sealed from moisture, dirt and other potentially detrimental materials that might otherwise accumulate therein during play. Such sealing is accomplished by means of a low density insert which is preferably made of a low mass density material such as plastic, rubber, epoxy or low density metal material such as titanium or aluminum. An additional feature of the present invention comprises an aspect of the structure thereof which varies from club to club in a set of irons. More specifically, a weight shift slot is used to vary the center of gravity between the toe and heel as a function of the loft of the club to provide maximum accuracy of trajectory and ball hitting capability, depending upon whether the club is a long, low loft club or a shorter, high loft club. The low density insert serves the additional function of dampening sound and vibration upon ball impact.

17 Claims, 5 Drawing Sheets

SET OF GOLF CLUB IRONS HAVING A LOW DENSITY REAR CAVITY PERIMETER INSERT FOR SELECTED WEIGHT DISTRIBUTION OF EACH IRON

BACKGROUND OF THE INVENTION

FIELD OF THE INVENTION

The present invention relates generally to the field of golf club irons and more specifically to an improved iron having a low density cavity perimeter insert for selectively distributing the weight of the iron from the cavity area to the perimeter thereof for improved golf club performance. In a preferred embodiment hereof, an entire set of golf club irons is provided. The weight distribution in each such iron of the set is selectively modified with respect to the remaining irons in the set by using a weight shift slot which effectively shifts the weight distribution either towards the heel or towards the toe of the iron as desired.

PRIOR ART

The desire for perimeter weighting in a golf club iron is well-known in the art. This desire stems from the fact that as the mass of the iron is distributed towards the perimeter, the trajectory of the hit ball becomes more accurate, despite off-center hits away from the sweet spot of the golf club face or hitting surface. Consequently, most modern golf club irons have a rear cavity which extends towards the rear side of the face surface of the iron. The weight of the iron that is saved by creating this cavity, is re-distributed to the perimeter of the golf club head. The greater is the volume of the cavity, the greater is the amount of mass of metal that can be redistributed to the perimeter of the golf club head. However, if the thickness of the face hitting surface is reduced to an extent where it becomes too thin, eventually a point is reached at which the strength of the face surface becomes too low to resist deflection of that face upon hitting of the ball. A deflecting face surface can reduce the energy transmitted to the ball and thereby reduce the distance the ball can be hit. Furthermore, it can impact the accuracy of the trajectory of the ball in view of the unpredictability of the effect of the deflection of the face on the ball itself. Thus, it would be desirable to find a way to further increase the volume of the cavity without making the face surface so thin that it would deflect upon impact with the ball. One way of achieving this increase in cavity volume is to increase the cross-section of the cavity as it approaches the rear of the front face or hitting surface of the club head, or in other words, create an undercut rear cavity perimeter. Unfortunately, such an undercut perimeter creates a trap area in which dirt and moisture can accumulate, which can otherwise create a surface integrity problem as a result of rust or otherwise detrimentally affect the aesthetics of the club head which can reduce its commercial success. Accordingly, it would be desirable to provide a golf club iron head having perimeter weighting with selective weight distribution from the cavity to the perimeter of the head using an undercut perimeter which overcomes the aforementioned problem of the accumulation of moisture and dirt that otherwise could detract from the aesthetics or surface appearance of the club head. As is well-known in the golf club art, a typical set of golf club irons includes 9 or 10 irons having variations in shaft length, weight, lie and loft among other parameters. By way of example, the iron having the lowest weight, longest shaft and the lowest loft is typically the number one iron and the club having the shortest shaft and the highest loft is typically called a wedge, such as a lob wedge. It has been found that it is not necessarily appropriate for perimeter weighted clubs to have an equal distribution of weight in all irons of a set. More specifically, it has been found that in the longer, lower lofted clubs, such as the number 1 iron, number 2 iron, etc., it is preferable to have the displaced cavity weight shifted towards the toe. It has also been found advantageous to have the weight distribution in the shorter clubs, such as the 8 iron, 9 iron and wedges to have more displaced cavity weight shifted towards the heel. It has been further found advantageous to have little or no weight distribution shift in the middle irons, such as the 4 iron, 5 iron and 6 iron where weight redistribution resulting from the use of a large rear cavity, may be substantially equally distributed between toe and heel so that the center of gravity of the club head remains substantially along the central axis thereof, transversely across the face of the club. Some prior golf club irons which have been designed by those who have recognized the desirability of changing weight distribution, have used added weight along the cavity perimeter to effect such variations and distributions with club length and loft. Unfortunately, the use of additional weight in this manner, has the detrimental effect of adding weight back into the cavity and thus diminishing the advantage initially derived by creating a cavity in the first place.

Thus, it would be also desirable to provide a means for selectively distributing the weight in each iron of a set of golf club irons, either toward the toe or heel of the iron in a selected manner, but without reducing the advantage derived from creating the cavity and shifting the weight to the perimeter of the golf club head.

SUMMARY OF THE INVENTION

The present invention overcomes the disadvantages of the prior art by providing a set of golf club irons in which each such iron achieves selective weight distribution. This is accomplished by utilizing an increased cavity volume achieved by the use of an undercut perimeter which is protected from the environment by means of a low density insert made of a lightweight material such as plastic, rubber or elastomer. The relative low density of the insert material adds no substantial weight to the cavity, but it does protect the undercut perimeter of the cavity in a manner which prevents water or dirt or other extraneous materials from entering the undercut region which would otherwise diminish the appearance or even the performance of the golf club iron. The insert also dampens sound and vibration of the club upon impact with the golf ball.

A significant feature of the present invention comprises a weight shift slot in the cavity perimeter which is designed to receive a congruently shaped insert flange of the low density insert. The significance and advantage of this particular configuration in the present invention is that it may be varied from club to club, thus permitting modification of the weight distribution characteristics over a full set of golf club irons. In this manner, it is possible utilizing the innovative structure of the present invention to vary center of gravity location using a shift in weight distribution towards either the heel or the toe of the iron, depending upon the shaft length and loft of the selected iron. Thus, by way of example, the longest iron, namely the number 1 iron in a set of irons of the present invention, provides a weight shift towards the toe of the iron and the shorter irons, for example the wedges thereof, provide a weight shift towards the heel of the iron. In this manner, it is possible to even further increase the performance characteristics of the iron in a manner which permits longer and straighter long iron shots and more loft and control of short iron shots.

OBJECTS OF THE INVENTION

It is therefore a principal object of the present invention to provide an improved golf club iron having an enlarged rear cavity for enhanced redistribution of the weight of the iron from the cavity region to the perimeter of the iron to enhance golf club hitting accuracy and trajectory.

It is another object of the present invention to provide an improved set of golf club irons, each such iron having an undercut perimeter cavity which increases the area of the cavity and further redistributes weight towards the perimeter of the golf club head.

It is still a further object of the present invention to provide a set of golf club irons having an increased cavity volume resulting from the use of an undercut perimeter, sealed off from the environment by a low density insert which may be made of a lightweight material, such as plastic or rubber or the like.

It is still a further object of the present invention to provide an improved set of golf club irons having redistributed weight from an increased cavity volume to the perimeter of the golf club iron head, wherein weight distribution across the face of the iron between the toe and the heel, may be varied from club to club within the set of irons in order to maximize the performance of each iron for its intended ball hitting distance and trajectory.

BRIEF DESCRIPTION OF THE DRAWINGS

The aforementioned objects and advantages, as well as additional objects and advantages thereof, will be more fully understood hereinafter as a result of a detailed description of a preferred embodiment of the invention, when taken in conjunction with the following drawings wherein.

DETAILED DESCRIPTION OF A PREFERRED EMBODIMENT

Figure 2:
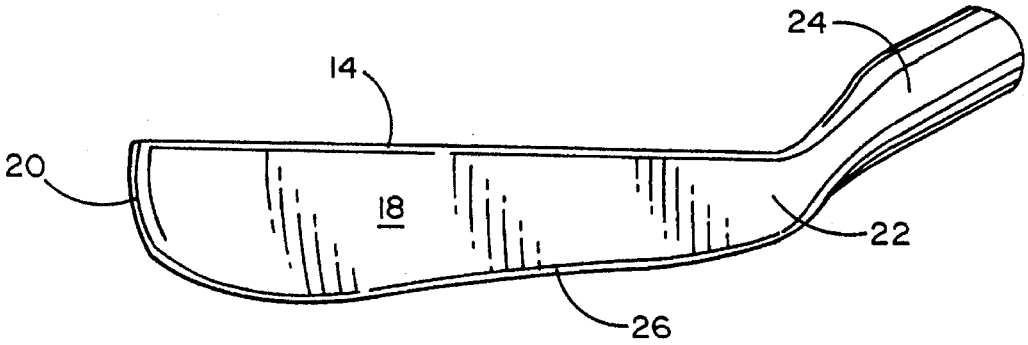
FIG. 2 is a bottom view thereof.
Figure 3:
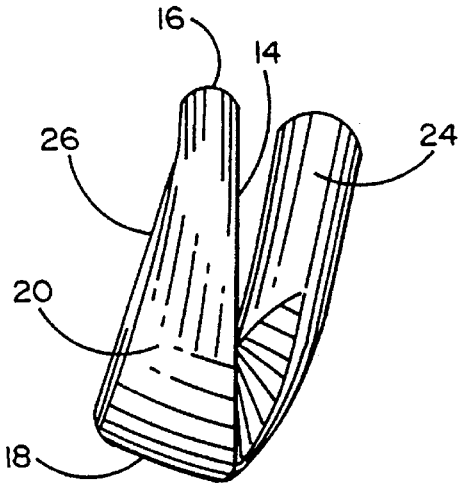
FIG. 3 is a toe-oriented view thereof.
Figure 5:
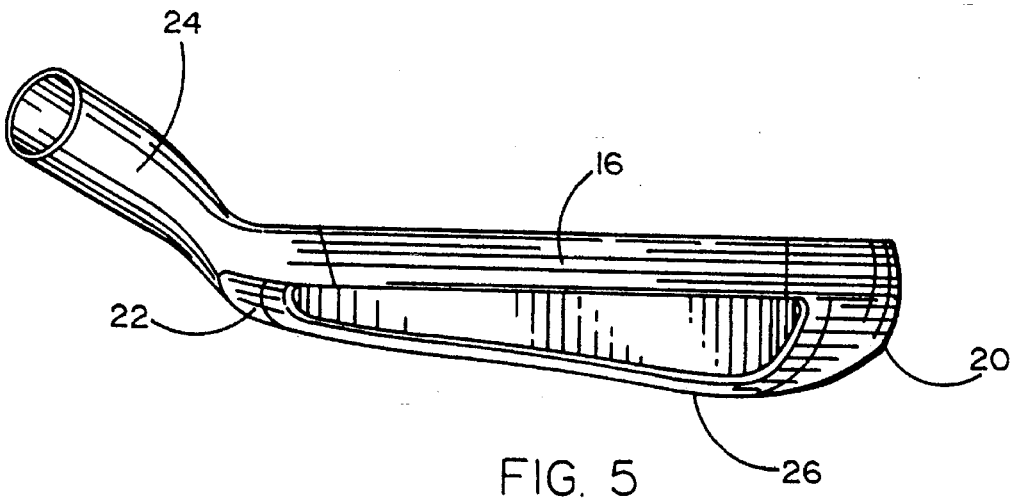
FIG. 5 is a top view thereof.
Figure 6:
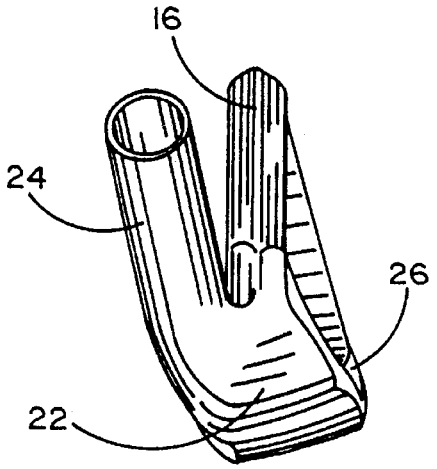
FIG. 6 is a heel-oriented view thereof.

Referring now to the accompanying figures, it will be seen that the golf club iron head 10 of the present invention comprises a head portion 12 to which is connected a hosel 24, which is in turn adapted to receive a shaft (not shown). The head portion 12 is defined by a face or hitting surface 14, which is outlined by a top line 16, a sole 18, a toe 20 and a heel 22. As best seen in FIGS. 3, 5 and 6, the golf club iron head 10 of the present invention comprises an unusually thickened top line structure 16. In fact, the thickness of the top line 16 makes it preferrable to employ a dual angle or beveled top line seen best in FIG. 6. It will also be seen best in FIGS. 2 and 3, that the sole 18 and toe 20 of the present invention are also thicker than usual in a golf club iron head. These larger than usual thicknesses of the top line, sole and toe of the golf club iron heads of the present invention are facilitated by an increased cavity volume, achieved in the present invention in the manner shown, for example, in FIG. 16. As shown in that figure, the irons of the present invention have a rear 26, each of which comprises predominantly, a rear cavity 28, which is encircled by a low density insert 30.

Insert 30 may be formed for example, of a low density plastic material which may be cured within the rear 26 of the iron head 10 during construction thereof or of other low density materials, including for example, rubber, elastomer, epoxy or low density metals, such as aluminum or titanium or a low density ceramic material, such as boron carbide or a matrix of a combination of such materials. It will be understood that the principal function of the low density insert 30 is to provide a seal to prevent the accumulation of dirt, moisture and other such undesirable materials in the region between the cavity 28 and the surrounding perimeter of the club, without significantly adding to the weight in that region. Thus, it is important that the material comprising the low density insert 30 be of low mass density or specific gravity and be a material which is appropriate to provide an airtight and watertight barrier against such extraneous and undesirable materials. This insert material is used to fill the region between the remaining open cavity 28 and the undercut perimeter 34 of the surrounding structure. The perimeter is undercut, that is, it increases in area toward the rear of the face 14, to further redistribute the weight of the club head towards the perimeter thereof. A secondary function of the insert is dampening sound and vibration of the golf club head upon impact with the golf ball.

Figure 15:
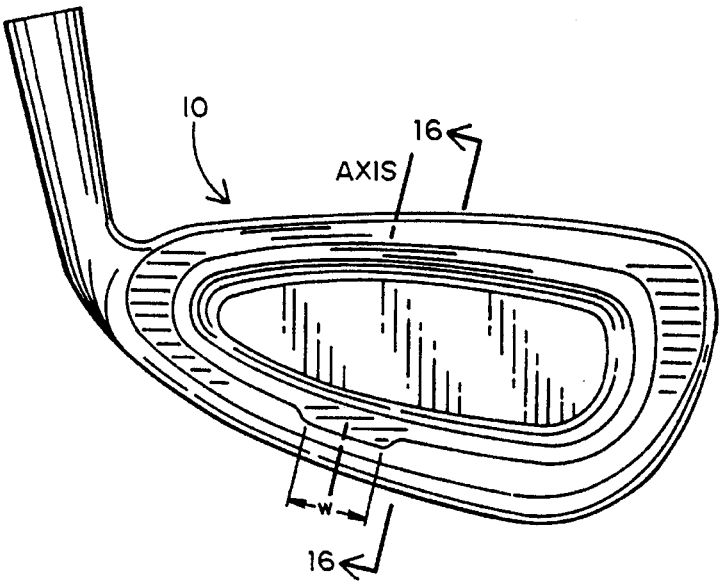
Figure 16:
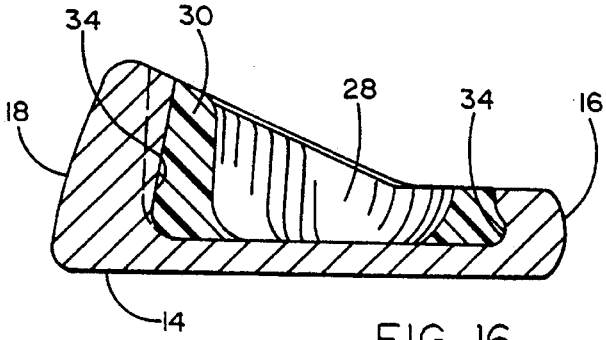
FIG. 16 is a cross-sectional view of a typical iron club of the present invention.
Figure 17:
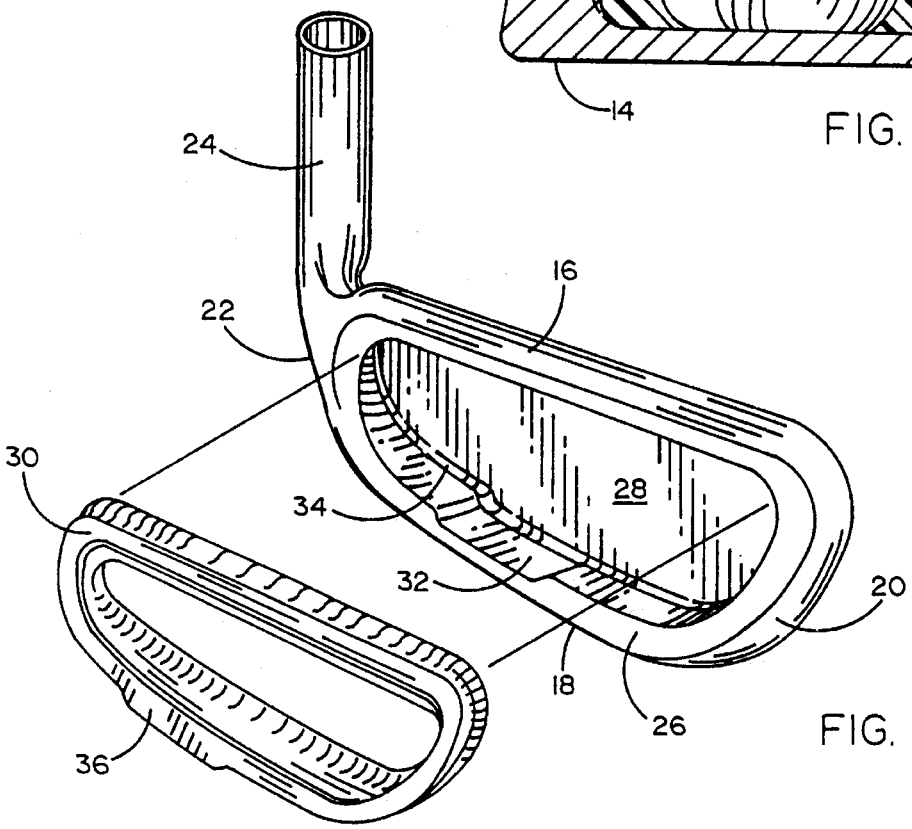
FIG. 17 is a three-dimensional exploded view of the invention, illustrating the shape of the insert thereof.

The resulting appearance of the rear 26 of each of the irons in a set of clubs disclosed herein is shown in FIG. 4 and FIGS. 7 through 15. As shown for example in FIG. 4, the rear 26 of the iron head portion 12, defines an exterior perimeter for a rear cavity 28. However, unlike all other golf club irons of the prior art, the rear cavity 28 is segregated from the rear perimeter 26 by a low density insert 30, which as previously indicated in conjunction with FIG. 16, is designed to fill and seal the undercut perimeter 34 shown in that figure.

Figure 4:
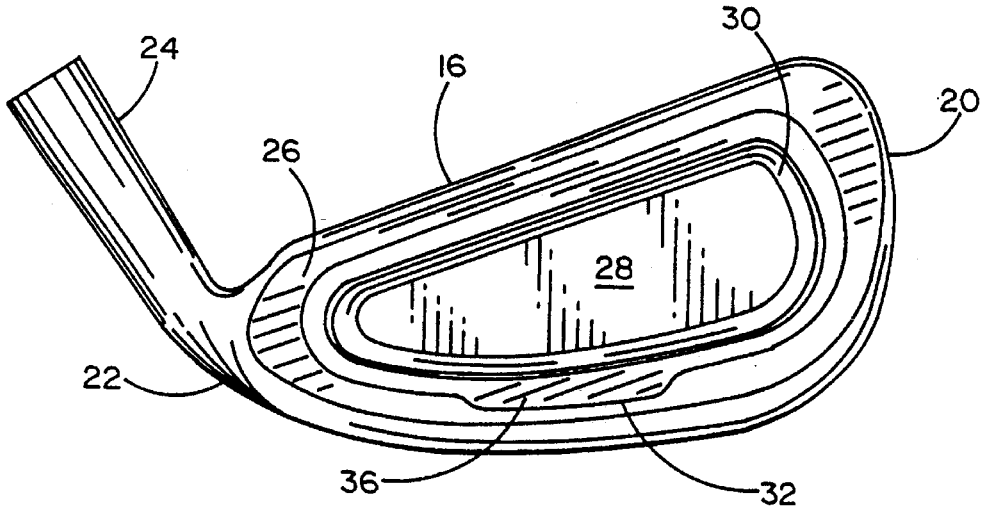
FIG. 4 is a rear view thereof.

As seen further in FIG. 4 and FIGS. 7 through 15, the appearance of the rear of each iron head is substantially identical except for conventional variations in the head itself such as the loft, lie and offset angles over a full set of club irons. However, in the present invention, there is still an additional variation from club to club resulting from the novel configuration of the present invention. More specifically, as seen in FIG. 4 by way of example, the rear perimeter 26 is provided at the lowest portion thereof, adjacent the sole 18 with a weight shift slot 32 and the low density insert 30 is provided with a matching or congruent insert flange 36.

Figure 7:
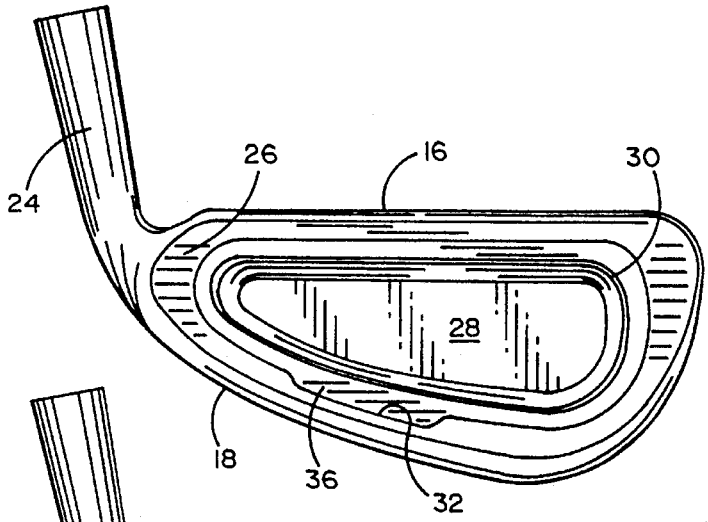
FIG. 7 through 15 provide rear elevational views of respective golf club irons in a set of irons in accordance with the present invention.

Slot 32 extends the full depth of cavity 28 to the rear surface of face 14 and provides for selectively varying the weight distribution or redistribution thereof to the perimeter of the golf club iron of the present invention because it effectively constitutes a removal of high density metal material from the region of the rear perimeter 26, adjacent the cavity 28. Accordingly, when the weight shift slot 32 is oriented more toward the toe of the iron, it effectively shifts the center of gravity of the iron towards the heel and when the slot is shifted towards the heel, the center of gravity is shifted towards the toe. Furthermore, a wide or elongated weight shift slot 32 is used in the longer irons where the clubs are lighter and longer so that maximum weight redistribution helps produce accurate trajectories from off-center hits. Thus, FIG. 4, which depicts a number 1 iron of the set of the clubs of the present invention, illustrates the use of a weight shift slot 32 which is the widest of the entire set and wherein the middle of the weight shift slot 32 is shifted toward the heel 22 of the club head, thereby effectively shifting the center of gravity toward the toe 20 of the club head. Similarly, FIG. 7 shows the number 2 iron, where the width of the slot 32 has been reduced slightly and the degree of shift of the center of the slot towards the heel of the club head has also been reduced slightly.

Figure 8:
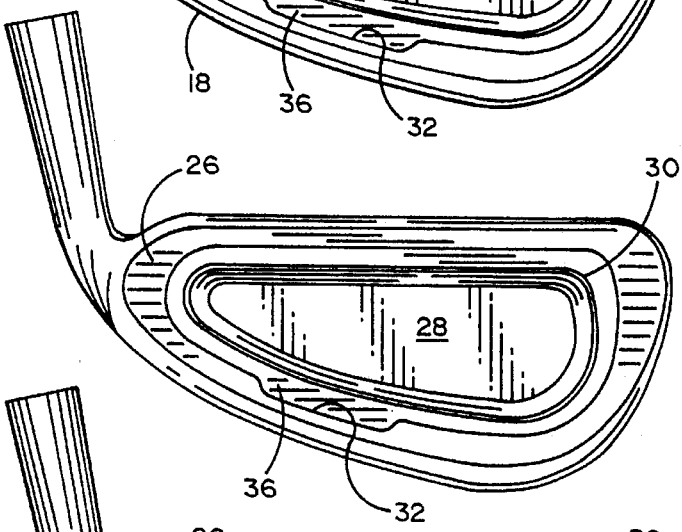
Figure 9:
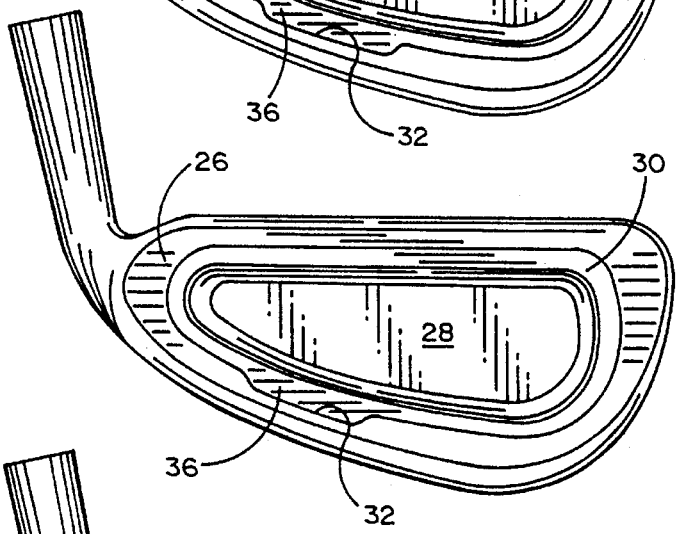
Figure 10:
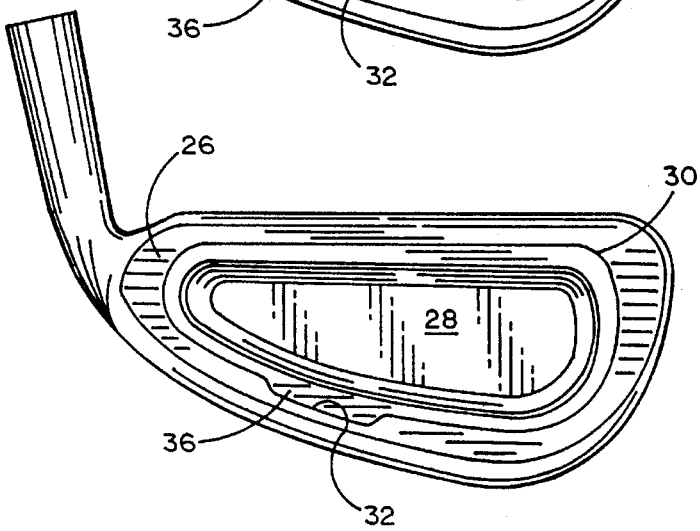
Figure 11:
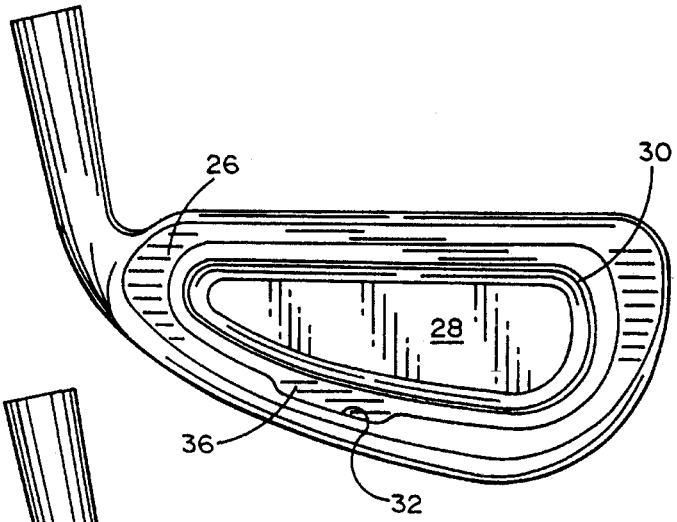
Figure 12:
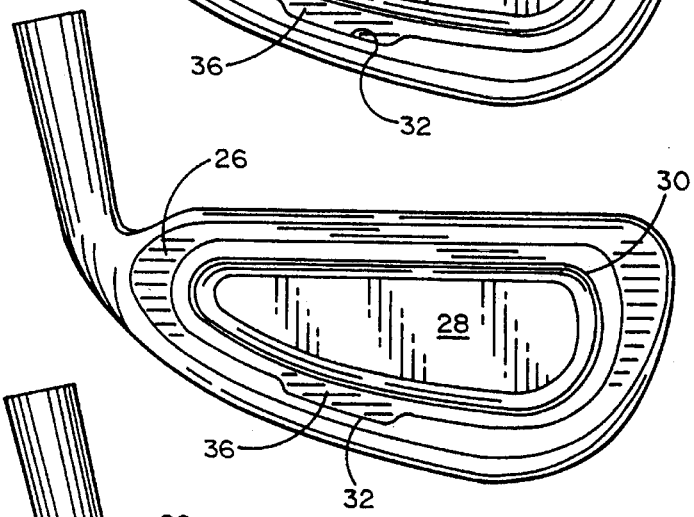
Figure 13:
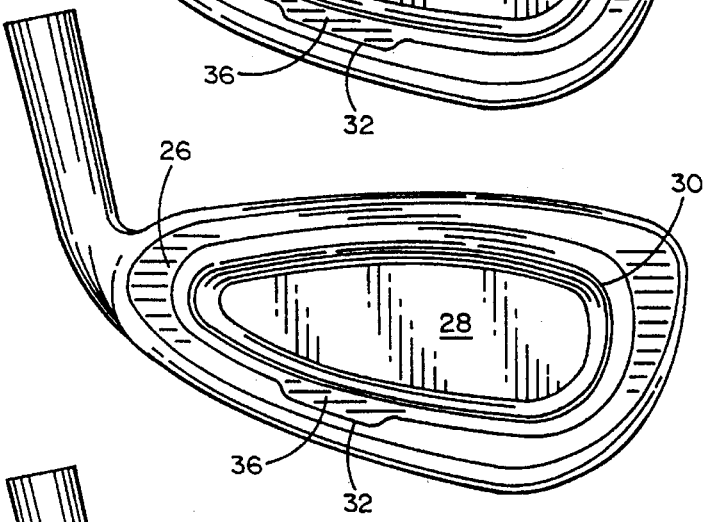
Figure 14:
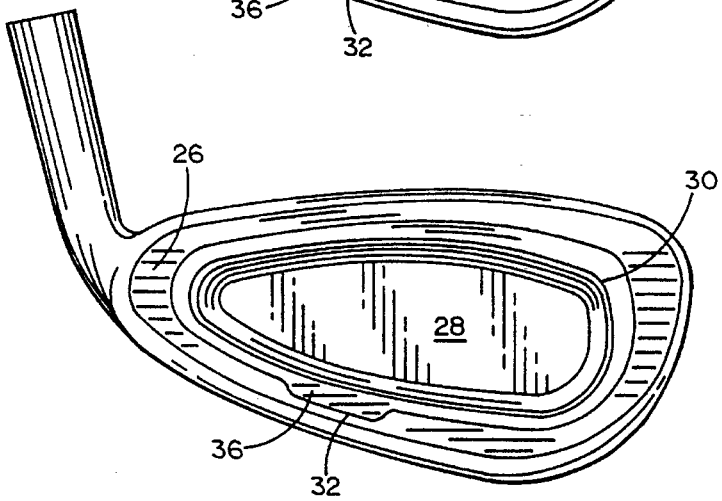

The width of the slot and the degree to which it is shifted to the heel are both decreased progressively with higher loft irons in FIG. 8, which illustrates the number 3 iron, FIG. 9 which illustrates the number 4 iron and FIG. 10 which illustrates the number 5 iron. Beginning with FIG. 11, which illustrates the number 6 iron, the slot is shifted toward the toe of the club head while the width of the slot continues to decrease. The width continues to decrease in FIG. 12 which illustrates the number 7 iron and the shift toward the toe increases. This reduction in width and shift towards the toe of the club head is retained and further increased in FIG. 13 which depicts the number 8 iron and in FIG. 14 which depicts the number 9 iron. FIG. 15 illustrates a typical wedge of a set of irons of the present invention in which the slot 32 is narrowest and its shift towards the toe of the head is at its greatest. In this manner, the number 1 iron of the present invention has a center of gravity which is shifted most toward the toe of the club head. This position of the center of gravity in the longer clubs of the present invention provides increased distance and accuracy for the long iron shots. On the other hand, the shorter, higher loft clubs of the present invention have the center of gravity shifted most towards the heel to provide the most control for short iron shots. Table I provides slot parameters for the preferred embodiment of the set of golf club irons disclosed herein.

TABLE I

WEIGHT SHIFT SLOT PARAMETERS

| IRON NO. | SLOT LENGTH (INCHES) | SLOT SHIFT (INCHES) TOWARD HEEL (–) TOWARD TOE (=) |
|---|---|---|
| 1 | 1.00 | −0.100 |
| 2 | 0.95 | −0.075 |
| 3 | 0.90 | −0.050 |
| 4 | 0.85 | −0.025 |
| 5 | 0.80 | 0.0 |
| 6 | 0.75 | +0.025 |
| 7 | 0.70 | +0.050 |
| 8 | 0.65 | +0.075 |
| 9 | 0.60 | +0.100 |
| WEDGES | 0.60 | +0.100 |

Figure 1:
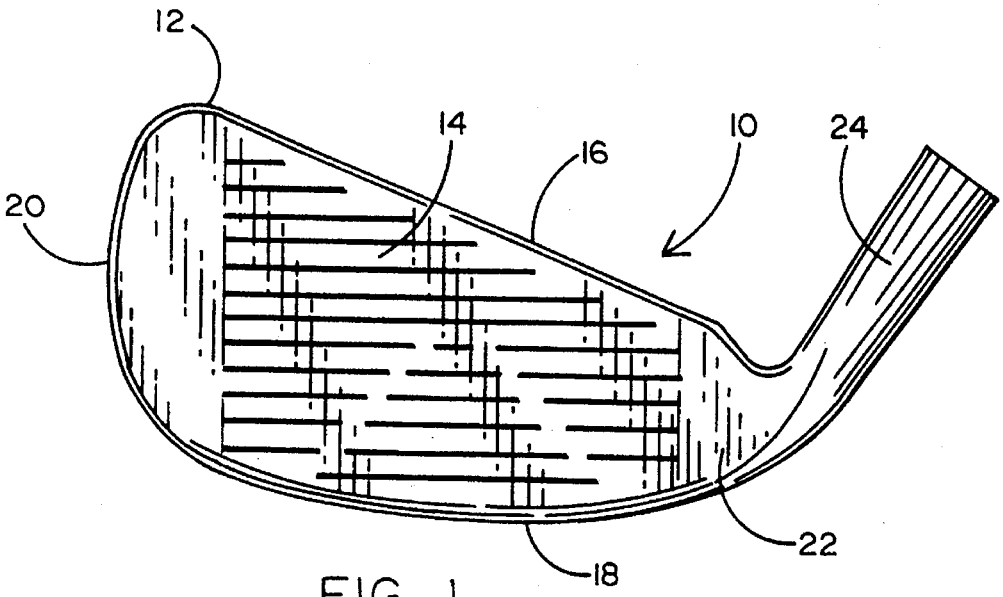
FIG. 1 is a front elevational view of a golf club iron in accordance with the present invention.

Two other significant features of the invention include the beveled topline shown in FIG. 6 and the unique alignment score lines of the face 14 shown in FIG. 1. The beveled topline prevents the unusually thick topline from distracting the golfer and the triangular-designed score line pattern enhances alignment of the club face with the ball during address.

Thus, it will be seen the present invention provides an improved set of golf club irons, wherein each golf club iron head has a novel structure for redistributing weight of the club towards the perimeter thereof, particularly in the rear cavity region. This is accomplished in the present invention by increasing the volume of the cavity by using an undercut perimeter which permits weight redistribution for example to increase the thickness of the top line, the toe and the sole of the club head. However, the undercut portion of the invention is sealed from moisture, dirt and other potentially detrimental materials that might otherwise accumulate therein during play. Such sealing is accomplished by means of a low density insert which is preferably made of a low mass density material such as plastic, rubber, epoxy or low density metal material such as titanium or aluminum. An additional feature of the present invention comprises an aspect of the structure thereof which varies from club to club in a set of irons. More specifically, in the present invention a weight shift slot is used to vary the center of gravity between the toe and heel, as a function of the loft of the club to provide maximum accuracy of trajectory and ball hitting capability, depending upon whether the club is a long, low loft club or a shorter, high loft club.

Those having skill in the art to which the present invention pertains, will now as a result of the applicant's teaching herein, perceive various modifications and additions which may be made to the invention. By way of example, the specific shape and material content of the insert portion of the present invention may be readily modified. In addition, the manner in which the center of gravity may be shifted from club to club within a set of irons of the present invention, may also be modified without diminishing the advantages derived from the structure of the invention. Accordingly, all such modifications and additions are deemed to be within the scope of the invention which is to be limited only by the claims appended hereto and their equivalents.

I claim:

1. A golf club iron having a front and a rear, the front having a hitting surface bordered by a top line, a sole, a toe and a heel, the rear having a central cavity bordered by a thicker perimeter; the iron comprising:

a cavity which increases in cross-section toward said hitting surface; and an insert configured as an annulus in said cavity in abutting contiguous relation with the perimeter of said cavity.

2. The golf club iron recited in claim 1 wherein said iron is made of a material having a first specific gravity and said insert is made of a material having a second specific gravity and wherein said first specific gravity is greater than said second specific gravity.

3. The golf club iron recited in claim 1 further comprising a beveled topline.

4. A golf club iron having a front and a rear, the front having a hitting surface bordered by a top line, a sole, a toe and a heel, the rear having a central cavity bordered by a thicker perimeter; the iron comprising:

a cavity which increases in cross-section toward said hitting surface; and an insert configured as an annulus in said cavity in abutting contiguous relation with the perimeter of said cavity;

further comprising an elongated slot in said perimeter of said cavity, said insert having a flange congruent to said slot for maintaining said abutting contiguous relation with said cavity perimeter.

5. The golf club iron recited in claim 4 wherein said slot has a length and position selected to effect the center of gravity of said iron.

6. The golf club iron recited in claim 4 wherein said iron is taken from the group consisting of irons having a loft angle corresponding respectively to a number 1 iron, a number 2 iron, a number 3 iron and a number 4 iron; said slot being located along said cavity perimeter adjacent said sole and being closer to said heel than to said toe.

7. The golf club iron recited in claim 5 wherein said iron is taken from the group consisting of irons having a loft angle corresponding respectively to a number 6 iron, a number 7 iron, a number 8 iron and a number 9 iron; said slot being located along said cavity perimeter adjacent said sole and being closer to said toe than to said heel.

8. The golf club iron recited in claim 4 wherein said slot extends into said cavity the full depth of said cavity.

9. A set of golf club irons, each iron having a front and a rear, the front having a hitting surface bordered by a top line, a sole, a toe and a heel, the rear having a central cavity bordered by a thicker perimeter; each such iron comprising:

a cavity which increases in cross-section toward said hitting surface; and an insert configured as an annulus in said cavity in abutting contiguous relation with the perimeter of said cavity.

10. A set of irons as recited in claim 9 wherein each said iron comprises a material having a first specific gravity and said insert is made of a material having a second specific gravity and wherein said first specific gravity is greater than said second specific gravity.

11. A set of irons as recited in claim 9 wherein each said iron has a ball-hitting face comprising a triangular pattern of score lines for improved ball alignment.

12. A set of golf club irons, each iron having a front and a rear, the front having a hitting surface bordered by a top line, a sole, a toe and a heel, the rear having a central cavity bordered by a thicker perimeter; each such iron comprising:

a cavity which increases in cross-section toward said hitting surface; and an insert configured as an annulus in said cavity in abutting contiguous relation with the perimeter of said cavity;

wherein each said iron comprises an elongated slot in said perimeter of said cavity, said insert having a flange congruent to said slot for maintaining said abutting contiguous relation with said cavity perimeter.

13. A set of irons as recited in claim 12 wherein in each said iron said slot has a length and position selected to effect the center of gravity of said iron.

14. A set of irons as recited in claim 13 wherein each said iron is taken from the group consisting of irons having a loft angle corresponding respectively to a number 1 iron, a number 2 iron, a number 3 iron and a number 4 iron; said slot being located along said cavity perimeter adjacent said sole and being closer to said heel than to said toe.

15. A set of irons as recited in claim 13 wherein each said iron is taken from the group consisting of irons having a loft angle corresponding respectively to a number 6 iron, a number 7 iron, a number 8 iron and a number 9 iron; said slot being located along said cavity perimeter adjacent said sole and being closer to said toe than to said heel.

16. The golf club iron recited in claim 12 wherein in each said iron said slot extends into said cavity the full depth of said cavity.

17. The golf club iron recited in claim 12 wherein each said iron further comprises a beveled topline.

* * * * *